United States Patent [19]

Van Gompel et al.

[11] Patent Number: 4,706,303

[45] Date of Patent: Nov. 17, 1987

[54] DISPOSABLE BIB WITH AN ELASTICIZED NECKBAND

[75] Inventors: Paul T. Van Gompel, Hortonville; Jody D. Suprise, Jacqueline A. Gross, both of Neenah, all of Wis.

[73] Assignee: Kimberly-Clark Corporation, Neenah, Wis.

[21] Appl. No.: 923,945

[22] Filed: Oct. 28, 1986

Related U.S. Application Data

[63] Continuation-in-part of Ser. No. 887,585, Jul. 16, 1986, abandoned.

[51] Int. Cl.[4] ..... A41B 13/10

[52] U.S. Cl. ..... 2/49 R

[58] Field of Search ..... 2/48, 49 A, 49 R, 50, 2/51

[56] References Cited

U.S. PATENT DOCUMENTS

| | | | |
|---|---|---|---|
| 2,174,694 | 10/1939 | Elson | 2/49 |
| 2,367,383 | 1/1945 | Tiscornia | 2/49 |
| 2,571,888 | 10/1951 | Jesse | 2/49 |
| 2,698,944 | 1/1955 | Ramsby | 2/48 |
| 2,708,273 | 5/1955 | Bonaventura | 2/48 |
| 3,146,465 | 9/1964 | Hummel | 2/49 |
| 3,793,644 | 2/1974 | Kellner | 2/49 |
| 3,995,321 | 12/1976 | Johnson | 2/49 |
| 3,999,221 | 12/1976 | Hannigan | 2/49 |
| 4,416,025 | 11/1983 | Moret et al. | 2/49 |
| 4,441,212 | 4/1984 | Ahr et al. | 2/49 |
| 4,445,231 | 5/1984 | Noel | 2/49 |
| 4,475,250 | 10/1984 | Savin et al. | 2/49 |
| 4,495,658 | 1/1985 | Moret et al. | 2/49 |

FOREIGN PATENT DOCUMENTS 1463863 2/1977 United Kingdom .

*Primary Examiner*—Doris L. Troutman
*Attorney, Agent, or Firm*—Paul Yee

[57] ABSTRACT

The present invention provides a protective garment which comprises a base sheet member having a neck opening aperture formed in a selected neckband section thereof. A neck elastic member is located in an overlying relation with a selected portion of the neckband section and is positioned at least partially adjacent to the neck opening aperture. An attaching mechanism secures the elastic member to the neckband section.

17 Claims, 12 Drawing Figures

DISPOSABLE BIB WITH AN ELASTICIZED NECKBAND

CROSS-REFERENCE TO RELATED CASES

This is a continuation-in-part of co-pending U.S. patent application Ser. No. 887,585 now abandoned entitled "Disposable Bib with Elasticized Neckband", filed July 16, 1986

FIELD OF THE INVENTION

The present invention pertains to protective garments, such as disposable bibs for infants. More particularly, the present invention pertains to a protective bib garment having a distinctive elasticized neckband which more effectively holds a garment on a wearer and provides a closer fit around the wearer's neck.

BACKGROUND OF THE INVENTION

The catcher pockets employed with conventional protective bibs have not readily remained open. As a result, various bib configurations have been developed to help hold open the bib pocket. For example, U.S. Pat. No. 3,995,321 issued Dec. 7, 1976 to S. Johnson discloses a bib which includes adhesive tabs designed to attach the front lip of the pocket to the edge of a table, thereby holding the bib pocket open. Other bib designs have employed a depending apron which is connected to the front lip of the bib pocket and which is configured to gravitationally open the pocket and hold it open. For example, see U.S. Pat. No. 4,495,658 issued Jan. 29, 1965 to D. Moret, et al.; U.S. Pat. No. 4,445,231 issued May 1, 1984 to J. Noel; U.S. Pat. No. 4,441,212 issued April 10, 1984 to N. Ahr, et al.; and U.S. Pat. No. 4,416,025 issued Nov. 22, 1983 to D. Moret, et al.

Bib configurations have also employed side gusset members to help hold the bib pocket open. For example, see British Patent No. 1,463,863 published Feb. 9, 1977 with K. Anderson as the listed inventor; and U.S. Pat. No. 2,367,383 issued Jan. 16, 1945 to J. Tiscornia.

To hold the garment on a wearer, conventional bibs have typically employed tie straps having various configurations. Examples of such tie straps are shown in U.S. Pat. No. 4,475,250 issued Oct. 9, 1984 to B. Savin, et al.; U.S. Pat. No. 3,793,644 issued Feb. 26, 1974 to I. Kellner; U.S. Pat. No. 3,999,221 issued Dec. 28, 1976 to L. Hannigan; U.S. Pat. No. 3,146,465 issued Sept. 1, 1964 to R. Hummel; and U.S. Pat. No. 2,174,694 issued Oct. 3, 1939 to A. Elson. A disposable baby bib employing an elastic strip having spring clips at its opposite ends is described in U.S. Pat. No. 2,571,888 issued Oct. 16, 1951 to K. Jesse.

Conventional protective bib garments, such as those described above, have not been completely satisfactory. The bib garments have not provided a sufficiently reliable and convenient mechanism for holding the catcher pocket open. For example, the bib configurations which attach a part of the bib to a piece of furniture can undesirably limit the movement of the wearer and can put excessive stresses on the bib structure. In addition, the securing straps employed by conventional bib configurations are often cumbersome to tie and can undesirably loosen during use.

BRIEF DESCRIPTION OF THE INVENTION

The present invention provides a distinctive protective garment, which includes a base sheet member which has an opening formed in a selected neckband section thereof. An elastic member is located in an overlying relation with a selected portion of the neckband section and is positioned at least partially adjacent to the opening. Attaching means secure the elastic member to the neckband section.

In a particular aspect of the invention, the protective garment comprises a base sheet member which has an opening formed in a selected neckband section thereof. An elastic member is located along a selected portion of the neckband section and is positioned at least partially adjacent to the opening. A layer of thermoplastic material overlies the elastic member and is bonded to the base sheet member and the elastic member to secure the elastic member to the base sheet member.

In a further aspect of the invention, the protective garment includes a base sheet member, and a catcher member connected in facing relation with a selected portion of the base sheet member to form a catcher pouch. A pouch elastic member is connected to the garment and is constructed and arranged sufficiently proximate to a bottom edge of the catcher member to foreshorten the catcher member bottom edge and hold open the pouch.

The distinctive garment of the invention can advantageously provide a more effective and convenient mechanism for securing the protective garment around the neck of a wearer. The elasticized neckband region of the garment is generally self-adjusting and can provide a closer fit against the wearer.

The embodiment of the invention which includes an elasticized catcher pouch member can provide a more effective capture and containment mechanism. The catcher pouch can more readily remain in the open position and can more effectively catch and retain spilled liquids or dropped solids.

BRIEF DESCRIPTION OF THE DRAWINGS

The invention will be more fully understood and further advantages will become apparent when reference is made to the following detailed description of the invention and the drawings, in which.

DETAILED DESCRIPTION OF THE INVENTION

The following detailed description of the invention is made in the context of a protective bib garment. However, it will be readily apparent to a person having ordinary skill in the art that the structures of the present invention can be incorporated into other protective garments, such as aprons, gowns and the like.

Figure 2:
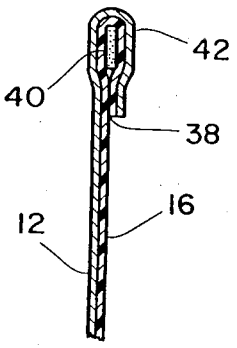
FIG. 2 representatively shows a partial cross-sectional view taken along line 2—2 of FIG. 1.
Figure 1A:
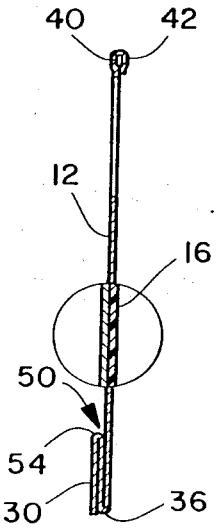
FIG. 1A representatively shows a partially magnified cross-sectional view of the protective garment shown in FIG. 1.
Figure 1:
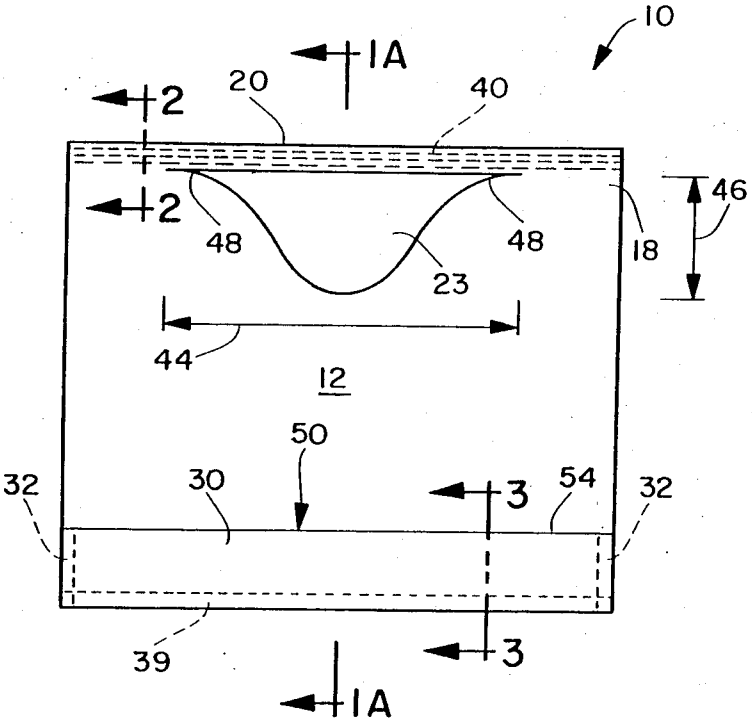
FIG. 1 shows a plan view of a representative bib garment of the invention.
Figure 5:
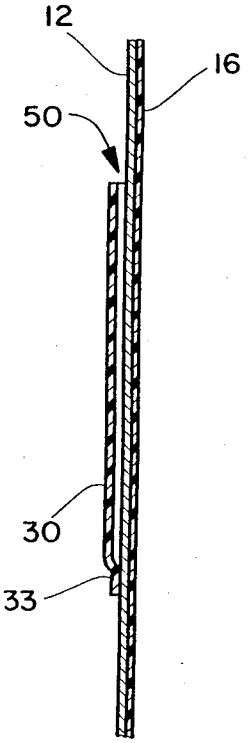
FIG. 5 representatively shows a partial cross-sectional view taken along line 5—5 of FIG. 6.
Figure 4:
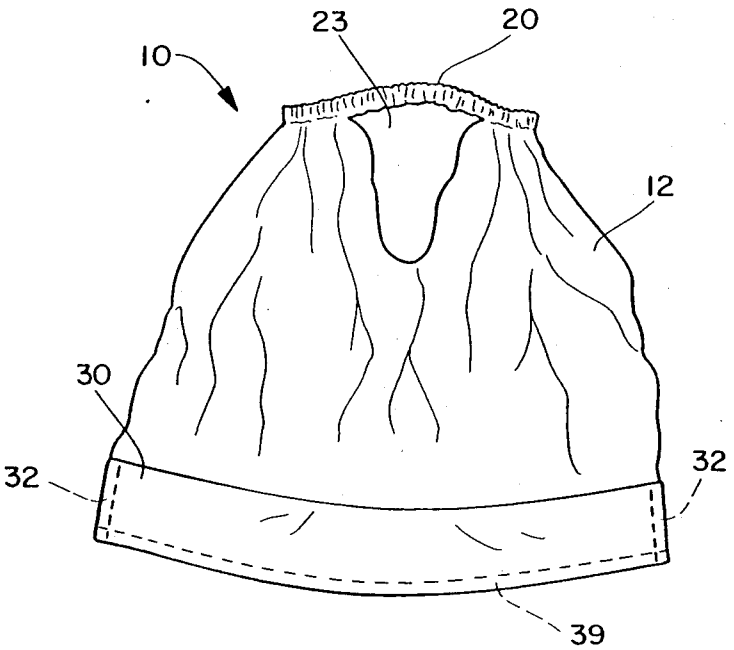
FIG. 4 representatively shows an isometric view of a protective garment in which the neckband section has been contracted and shirred by an elastic member.

Referring to FIGS. 1–2, a protective garment, such as bib 10, includes a base sheet member 12 which has a neck opening aperture 23 formed in a selected neckband section 18 thereof. An elasticizable member, such as neck elastic 40, is located in an overlying relation with a selected portion of neckband section 18 and is positioned at least partially adjacent to the neck opening aperture. An attaching means, such as folded-over neckband portion 42 secures neck elastic 40 to neckband section 18. In a particular aspect of the invention, bib 10 further comprises a catcher member 30 connected in an adjacent, facing relation to a selected portion of base sheet member 12 to form a catcher pouch 50 which opens toward a generally upward direction.

In the illustrated embodiment, base sheet member 12 is generally rectangular in planform. However, it is readily apparent that various other types of planforms, such as trapezoidal and oval planforms, may also be employed with equivalent effect. In particular embodiments of the invention, base sheet 12 comprises a layer of gatherable, cloth-like, fibrous nonwoven material, such as a web or sheet of thermally bonded polypropylene staple fibers or spunbonded polypropylene filaments. Other suitable materials include, for example, thermally bonded polyesters, blends of polypropylene and polyester, and blends of polypropylene, polyester, cotton, rayon, chisso, and the like. In particularly preferred embodiments, base sheet 12 is composed of materials which exhibit at least some degree of absorbency. Such materials can absorb spilled liquids and reduce the amount of liquid run off that might otherwise soil the clothing of the wearer.

In a particular aspect of the invention, base sheet 12 also includes a thermoplastic layer 16 which is positioned in a facing relation with base sheet 12 and is bonded to the base sheet to form a laminated structure. The thermoplastic layer extends over and covers substantially the entire surface of base sheet 12. Preferably, thermoplastic layer 16 provides a substantially liquid impermeable barrier to protect the clothes of the wearer and forms an appointed bodyside surface of the garment.

In the shown embodiment, thermoplastic layer 16 is composed of a gatherable polymeric material, such as polypropylene, polyethylene or copolymers of polyethylene. Other suitable thermoplastic materials include, for example, polymers of ethylene acrylate, ethylene-methyl acrylate, ethylene-vinyl acetate, ethylene-ethyl acetate, and blends or co-extrusions of copolymers of two or more of the foregoing.

Figure 6A:
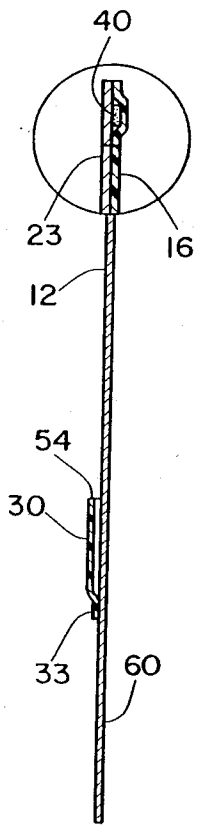
FIG. 6A representatively shows a partially magnified cross-sectional view taken along line 6A—6A of FIG. 6.
Figure 6:
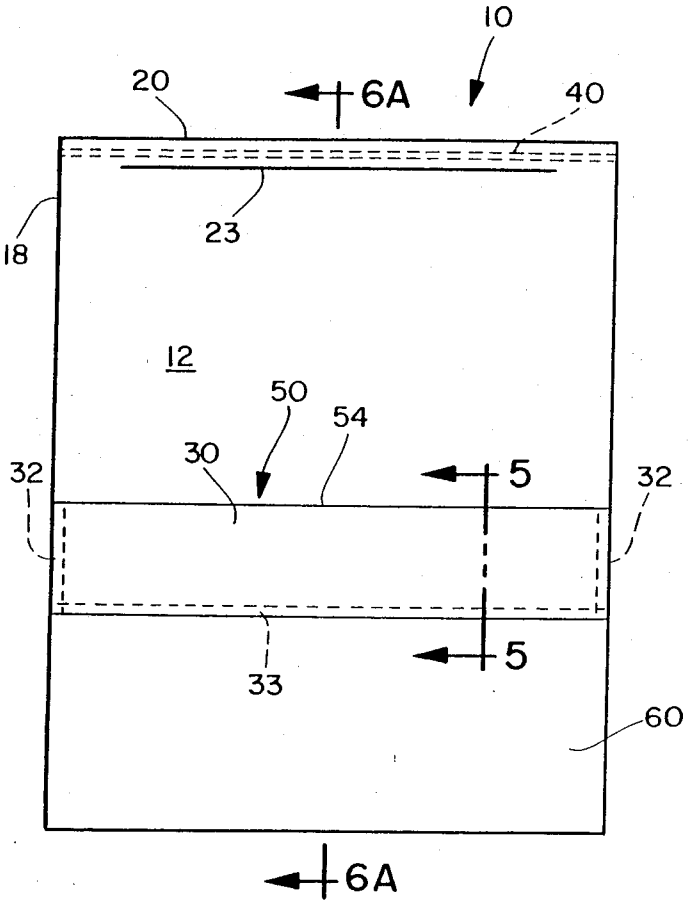
FIG. 6 representatively shows a plan view of another embodiment of a bib garment of the invention.

Neck aperture 23 is formed through neckband section 18 of base sheet 12, and is configured and arranged to define a neck strap section 20. The neck aperture is formed through all of the layers comprising base sheet 12, can have various configurations. For example, the neck aperture may have a rectilinear-shape outline or a curvilinear-shaped outline. The neck aperture may be crescent-shaped or even bell-shaped as representatively shown in FIG. 1. In an alternative configuration, neck aperture 23 may be configured as a linear or curvilinear slit formed into base sheet 12. Such a slit-type opening is representatively shown in FIG. 6. As illustrated in FIG. 6, the contraction and shirring effect caused by neck elastic 40 can effectively open up the slit aperture and provide a stretchable strap which can be fitted over the wearer's head.

The shown embodiment of elastic strap 20 extends adjacently along neck aperture 23 in a generally transverse direction, and is integrally attached to the remainder of base sheet 12. The strap can be suitably stretched to allow the placement of the garment over the head of a wearer, and can then be permitted to elastically contract to hold the garment in a closely fitting position around the neck of the wearer. This close fit advantageously reduces any gap between the bib outline and the wearer's neck and reduces the probability that spilled materials might fall through the gap onto the wearer's clothing.

In particular aspects of the invention, the transverse extent 44 of neck aperture 23 ranges from about 4–12 inches (about 10.0–30 cm), and preferably measures about 9 inches (23 cm). The depth 46 of neck aperture 23 ranges from about 2–6 inches (about 5.0–15 cm) and preferably measures about 3 inches (about 8 cm). In a particularly preferred embodiment, neck aperture 23 has a bell-shaped, curved outline contour which includes tapered tails 48 at each transverse end thereof. Each of the tapered tails extends transversely about 1–4 inches (about 2.5–10.0 cm) and preferably extends about 1.5 inches (about 3.7 cm). Tapered tails 48 can advantageously allow a greater extension of the elasticized neck strap 20 without increasing the effective size of neck aperture 23, while still maintaining a close fit to the neck of the wearer.

Neck elastic member 40 is comprised of a suitable elastomeric material. Such materials include, for example, self-adhering block copolymers of polystyrene, polyisoprene, or polybutadiene copolymers of ethylene, natural rubbers, urethanes, Kratons and co-extrusions/-blends of the aforementioned. Other examples of suitable elastomeric materials include copolymers of ethylene, EVA (ethylene-vinyl acetate), EEA (ethylene-ethyl acetate), EAA (ethylene-acrylic acid) and EMA (ethylene-methyl acrylate) and various percent blends of the copolymers of ethylene with polypropylene. Co-extruded composites of EVA (ethylene-vinyl acetate), EEA (ethylene-ethyl acetate), EAA (ethylene-acrylic acid), and EMA (ethylene-methyl acrylate) and polypropylene at various percents or mil thicknesses could also be used as the elastic material.

To provide improved effectiveness, the elastomeric material should be capable of providing an elastic extensibility of at least about 50%. This elastic extensibility is determined by the formula, $(L_2-L_1)/L_1$;

wherein:

$L_1$ is the relaxed, contracted length of the elastomeric material; and $L_2$ is the maximum elongated length of the elastomeric material.

To further improve the effectiveness and comfort of the garment, the elastomeric material has a modulus of about 60–110 psi (45–104 KPa), and preferably has a modulus of about 90–110 psi (67–82 KPa). This modulus is measured on a sample which is 13 cm in length and is stretched to an elongation of 200%.

In the embodiment illustrated in FIG. 1, neck elastic 40 is stretched and elongated by a selected amount and then placed in an overlying relation with neck strap 20. Preferably, neck elastic 40 is located against the thermoplastic film layer 16, and extends in the crosswise, transverse direction of the garment. A portion of neck strap 20 is then folded over along a transverse extending fold line to cover and overlie at least a portion of neck elastic 40. The folded overlapping portions of neck strap 40 contacts thermoplastic layer 16 against itself and provides a convenient mechanism for securing neck elastic 40 on neck strap 20. In particular, the thermoplastic layer 16 which overlaps neck elastic 40 can be heated by conventional means to form a securement bond with the neck elastic and to thermally fuse the thermoplastic layer against itself to form a bond 38 (FIG. 2). It will be readily apparent, however, that other attaching methods may be employed to secure the neck elastic onto the neck strap. For example, the neck elastic may be adhesively bonded to neck strap 20 or may be mechanically staked to the neck strap.

Figure 7:
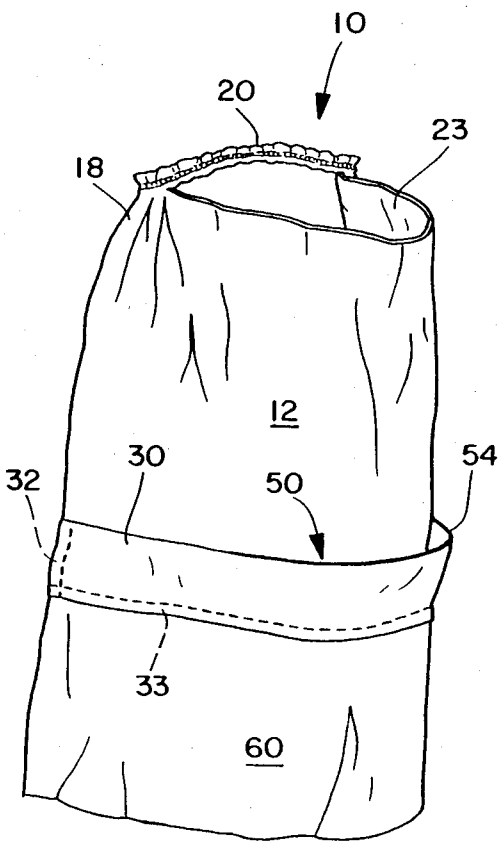
FIG. 7 representatively shows an isometric view of the garment shown in FIG. 6 in which the neckband section has been contracted and shirred by an elastic member.

Referring now to another aspect of the invention representatively shown in FIGS. 6–7, base sheet member 12 has a neck opening aperture 23 formed through a selected neckband section 18 thereof. A neck elastic member 40 is located along a selected portion of neckband section 18 and is positioned at least partially adjacent to neck aperture 23. A layer of thermoplastic material 16 overlies elastic member 40 and is bonded to base sheet 12 and to elastic member 40 to secure the elastic member to the base sheet.

To produce an elasticized neck strap 20, neck elastic 40 is operably held in an elongated, contractible condition. The elongated elastic is then placed onto neck strap section 20 and is positioned generally adjacent to the top edge of neck aperture 23. A layer of thermoplastic material 16 is then applied and secured to at least the neckband section 18 of base sheet 12. Thermoplastic layer 16, for example, can be directly extruded onto the base sheet. The applied thermoplastic layer is configured to overlie the stretched elastic member 40 and is bonded or otherwise attached to both the elastic member and the base sheet. This laminated-type structural arrangement effectively secures neck elastic 40 to base sheet 12. When the tension force employed to stretch neck elastic 40 is suitably released or is otherwise activated, the neck elastic contracts to shir and elasticize neck strap 20.

If desired, an optional catcher member 30 can be connected in facing relation with a selected portion of base sheet 12 and arranged to span across the transverse width of the base sheet. Bottom edge attachment 33 and side edge attachments 32 secure the respective edges of the catcher member to base sheet 12 to form a catcher pouch 50, as illustrated in FIGS. 6–7. During use, the catcher pouch top edge 54 opens toward a generally upward direction.

Figure 3:
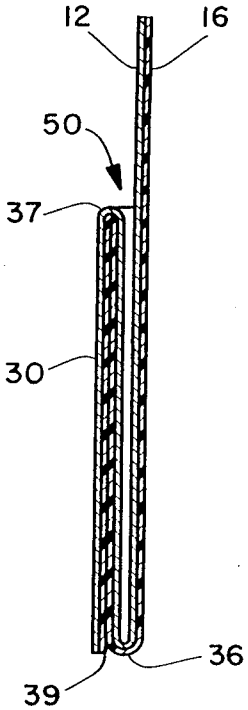
FIG. 3 representatively shows a partial cross-sectional view taken along line 3—3 of FIG. 1.

Alternatively, catcher member 30 is formed by folding a longitudinal end portion of base sheet 12 along a generally transverse fold line 36, as representatively shown in FIG. 1A. The folded-up portion is then connected to the main base sheet member with suitable side edge attachment means 32. These side edge attachment means may, for example, comprise sonic bonds or adhesive bonds or thermal bonds. In yet another alternative arrangement, a longitudinal end portion of base sheet 12 can be double-folded, as illustrated in FIG. 3, to form catcher member 30. The catcher pouch is formed with a first, bottom transverse fold line 36 and a second, top transverse fold line 37. This top fold essentially corresponds to the top edge of catcher pouch 50. As a result, the catcher member comprises a portion of base sheet 12 which is folded and then doubled back upon itself. This doubled-back structure is maintained with suitable securements, such as adhesive, or ultrasonic thermal bonds 39. With this arrangement, the cloth-like portion of base sheet 12 forms an outward facing surface of the catcher member and can present a more pleasing appearance.

In still another aspect of the invention, catcher member 30 can be spaced a selected distance away from the terminal longitudinal edge of base sheet 12, as illustrated in FIG. 7. This configuration provides a depending apron section 60 which can cover the lap of the wearer and can also be used as a clean-up towel.

Figure 9:
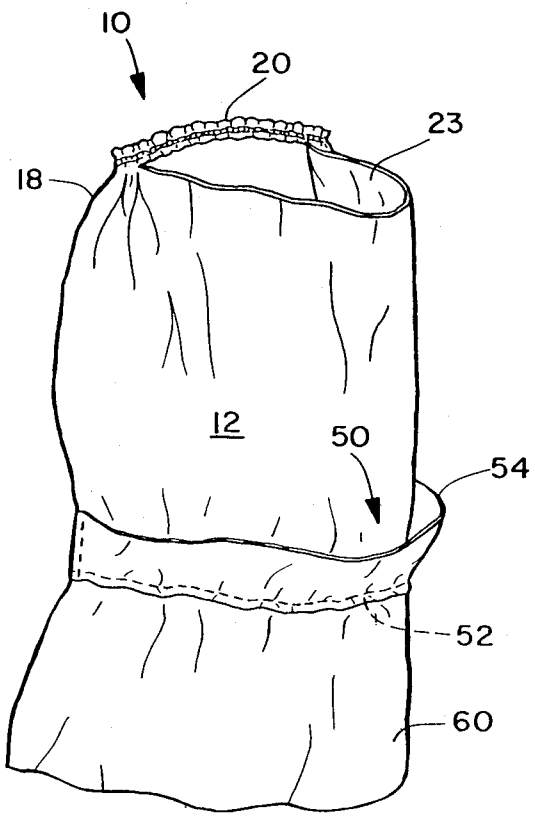
FIG. 9 representatively shows an isometric view of the garment shown in FIG. 8 in which the neckband section and the catcher pouch section have been shirred by elastic members.
Figure 8A:
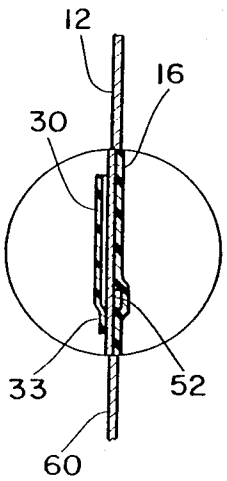
FIG. 8A representatively shows a partially magnified cross-sectional view taken along line 8A—8A of FIG. 8.
Figure 8:
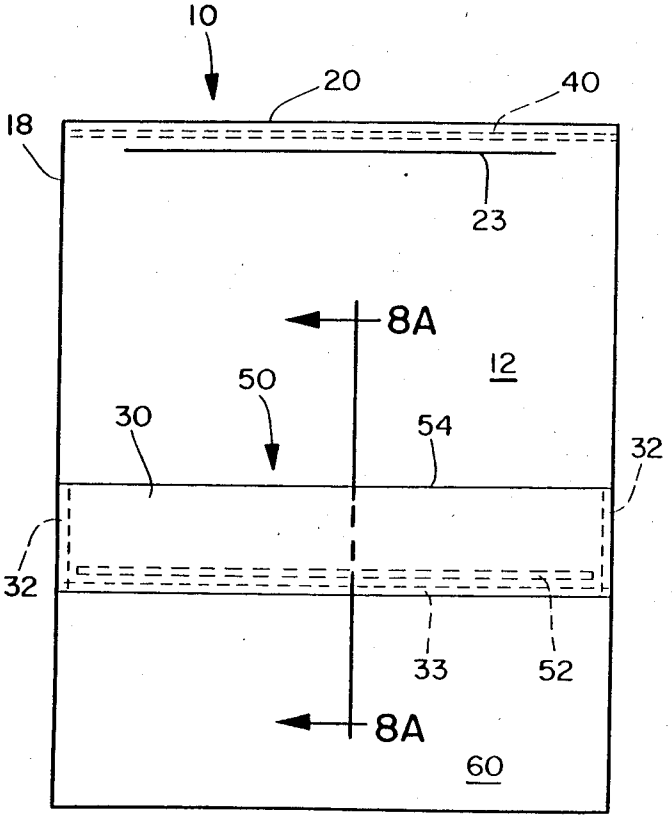
FIG. 8 representatively shows a plan view of a further embodiment of a bib garment of the invention.

A protective garment, such as bib 10, in a further aspect of the invention, comprises a base sheet member 12 and a catcher member 30. The catcher member is connected in facing relation with a selected portion of base sheet member 12 to form a catcher pouch 50. A pouch elastic member 52 connects to the garment, and is constructed and arranged sufficiently proximate to a bottom edge of catcher member 30 to foreshorten the catcher member bottom edge and to effectively hold open the catcher pouch 50. Referring to FIGS. 8–9, pouch elastic member 52 can be stretched or otherwise held in an elongated contractible condition, and then connected in facing relation with base sheet 12. The pouch elastic extends transversely across base sheet 12. Alternatively, pouch elastic 50 may be connected to catcher member 30. In either arrangement, the pouch elastic should be positioned sufficiently proximate to the bottom edge of catcher member 30 such that the pouch elastic causes the pouch bottom edge to shir a greater amount than the pouch top edge 54. A suitable attaching means, such as thermal, adhesive, or mechanical bonding, can be employed to secure pouch elastic 52 to the garment.

In a particularly effective embodiment of the invention, pouch elastic 52 is secured to base sheet 12 by a layer of thermoplastic film material 16. Pouch elastic 52 is suitably stretched and elongated by a selected amount to establish a contractible configuration, and is then located in a predetermined position onto base sheet 12. An extruded, thermoplastic layer 16 is then applied and bonded in an overlying, facing position onto pouch elastic 50 and base sheet 12. The thermoplastic layer is bonded to both the pouch elastic and the base sheet, and effectively secures the stretched pouch elastic to the base sheet in a laminated configuration. Catcher member 30 is then suitably attached to base sheet 12 with the bottom edge of the catcher member located generally parallel with and proximate to pouch elastic 52. The pouch elastic can then be allowed to elastically contract to shir base sheet 12. The shirring action also shirs and gathers the bottom edge 34 of catcher member 30 and foreshortens its bottom edge, relative to its top edge, to hold open catcher pouch 50. As a result, the catcher pouch can more readily remain in its open condition and can more effectively capture and contain any spilled liquids or dropped solids.

In yet another aspect of the invention, at least a portion of catcher member is constructed to be elastically contractible. For example, an elastic member in contractible condition can be affixed to a selected region of catcher member 30 and arranged such that a contraction of the elastic is capable of foreshortening the dimension of the catcher member that extends transversely across the width of bib 10. This elasticized catcher member, in turn, is connected along its bottom and lateral side edges to the primary base sheet member of the bib while the elastic is maintained in its stretched, contractible condition. Once the elastic is allowed to contract, the catcher member becomes elastically shortened and draws the lateral side edges of bib 10 inwardly toward the bib longitudinal centerline to create a pouch that readily remains open.

Another configuration of the invention employs an elasticized catcher member 30 substantially uniformly composed of an elastomeric material which is capable of stretching at least about 10% without undergoing any significant plastic deformation. This elastomeric material is sufficiently rigid such that it is operably self-supporting when connected to the bib base sheet member. For example, suitable elastomeric materials would include co-extruded films, or blends, such as ethylene-methyl acrylate/polypropylene, ethylene-vinyl acetate/polypropylene, Kraton/polypropylene, or ethylene-ethyl acetate/polypropylene, extruded at a gauge greater than about 0.001 inch but less than about 0.005 inch. Blends of the aforementioned materials at various percents could also be used.

The elastomeric catcher member is maintained in a stretched condition, preferably stretched about 10–30%, and affixed along its bottom and side edges to the bib base sheet with suitable fastening means, such as adhesive or thermal bonds. The catcher member material is then allowed to elastically contract to draw the lateral side edges of the bib inwardly toward the bib longitudinal centerline. The resultant configuration provides a pouch that can more readily hold an open position.

The various elastic members employed with the present invention have been described as being elongated, stretched or otherwise configured to establish a contractible condition. This contractible condition can, for example, be maintained by mechanically holding the elastic in a stretched condition with an applied tension. For example, the elastic may be stretched and then affixed to a heat softenable substrate, which at room temperature is sufficiently rigid to maintain the stretched condition of the elastic. The application of heat softens the substrate and allows the elastic to contract substantially to its unstretched condition. Alternatively, the contractible condition can be maintained by an intermolecular mechanism within the elastic material itself. For example, various elastomeric materials can be selectively oriented and then heat treated or irradiated to set the elastomer in an elongated condition. The elastomer can then be activated, such as with the application of heat, to allow the oriented elastomer to shrink and contract.

The following example is given to provide a more detailed understanding of the invention. The particular measurements, compositions, and parameters set forth in the example are exemplary and are not intended to specifically limit the invention.

EXAMPLE

A base sheet 12 was composed of thermally bonded polypropylene bonded carded web and measured 35.5×45.7 cm. A thermoplastic film layer 16 composed of ethylene-methylacrylate was extruded at a temperature between about 275°–315° C., and preferably at about 293° C., directly onto base sheet 12 to provide a film thickness of about 0.085 cm. The thermoplastic film layer covered substantially the entire surface of base sheet 12 and was pressed and bonded to the base sheet to provide a substantially liquid impervious bodyside layer. A bell-shaped aperture was then cut away from the neckband portion of base sheet 12 to form neck strap 20. The bell-shaped opening had a total transverse extent of about 23 cm and had a depth of about 8 cm.

A catcher pouch was formed by double-folding one longitudinal end of base sheet 12 to form a catcher member. The lateral side edges of the catcher member were then adhesively bonded to the main base sheet 12 to form a catcher pouch having a pouch depth of about 8 cm.

Having thus described the invention in rather full detail, it will be readily apparent to a person having ordinary skill in the art that various changes and modifications can be made without departing from the spirit of the invention. All of such changes and modifications are contemplated as being within the scope of the present invention, as defined by the subjoined claims.

We claim:

1. A protective garment, comprising:

a base sheet member which has a neck opening aperture formed in a selected neckband section thereof;

a neck elastic member located in an overlying relation with a selected portion of said neckband section and positioned at least partially adjacent to said neck opening aperture;

attaching means for securing said elastic member to said neckband section.

2. A protective garment as recited in claim 1, wherein said attaching means comprises a folded over portion of said neckband section which is affixed to and overlies at least a portion of said elastic member to provide said securement thereof.

3. A protective garment as recited in claim 2, wherein said base sheet member further comprises an extruded layer of thermoplastic material laminated onto said base sheet member, and wherein said folded over portion of said neckband section is configured with thermoplastic material folded against thermoplastic material.

4. A protective garment as recited in claim 3, further comprising a catcher member connected in a facing, adjacent relation to a selected portion of said base sheet member to form a catcher pouch.

5. A protective garment as recited in claim 4, wherein said catcher member comprises a double-folded, longitudinal end portion of said base sheet member.

6. A protective garment as recited in claim 3, wherein said folded over thermoplastic layer is bonded to itself and to said elastic member to thereby secure said elastic member to said neckband section.

7. A protective garment, comprising:

a base sheet member which has a neck opening aperture formed in a selected neckband section thereof;

a neck elastic member located along a selected portion of said neckband section and positioned at least partially adjacent to said neck opening aperture;

a layer of thermoplastic material, which overlies said elastic member and is bonded to said base sheet member and said elastic member, for securing said neck elastic member to said base sheet member.

8. A protective garment as recited in claim 7, wherein said base sheet member neck opening aperture has the form of a slit.

9. A protective garment as recited in claim 7, wherein said neck opening aperture has a crescent-shaped outline.

10. A protective garment as recited in claim 7, wherein said neck opening aperture in said base sheet member has a bell-shaped outline.

11. A protective garment as recited in claim 7, further comprising a catcher member connected to a selected portion of said base sheet member to form a catcher pouch.

12. A protective garment as recited in claim 7, wherein a pouch elastic member is connected to said garment and is constructed and arranged sufficiently proximate to a bottom edge of said catcher member to foreshorten said bottom edge and hold open said pouch.

13. A protective garment as recited in claim 7, wherein said neckband section has an elastic extensibility of at least about 50%.

14. A protective garment, comprising:

a base sheet member;

an elasticized catcher member connected in facing relation with a selected portion of said base sheet member to form a catcher pouch; said elastomeric catcher member constructed and arranged to elastically foreshorten said catcher member and draw lateral side edges of said base sheet member inwardly toward a longitudinal centerline of the garment.

15. A protective garment as recited in claim 14, wherein said elasticized catcher member comprises a pouch elastic member affixed to a selected region of said catcher member.

16. A garment as recited in claim 14, wherein said pouch elastic member is constructed and arranged proximate a bottom edge of said catcher member to elastically foreshorten said catcher member bottom edge.

17. A garment as recited in claim 14, wherein said elasticized catcher member is substantially uniformly composed of an elastomeric material.

* * * * *